US006042288A

United States Patent [19]

Rattinger et al.

[11] Patent Number: 6,042,288

[45] Date of Patent: Mar. 28, 2000

[54] SYSTEM COMPRISING SYNTHETIC DETERGENT BAR AND POUF FOR HOLDING BAR

[75] Inventors: Gail Beth Rattinger, Teaneck, N.J.; Peter Boettcher, Sterling Forest, N.Y.; Laurie Ann Coyle, Park Ridge; William Narath, Parsippany, both of N.J.

[73] Assignee: Lever Brothers Company, Division of Conopco, Inc., New York, N.Y.

[21] Appl. No.: 09/033,012

[22] Filed: Mar. 2, 1998

Related U.S. Application Data

[60] Provisional application No. 60/039,496, Mar. 4, 1997.

[51] Int. Cl.[7] ..... A47K 7/02

[52] U.S. Cl. ..... 401/201; 401/196

[58] Field of Search ..... 401/201, 196, 401/203, 198, 1

[56] References Cited

U.S. PATENT DOCUMENTS

| | | | |
|---|---|---|---|
| 1,292,982 | 1/1919 | Wolf . | |
| 1,905,163 | 6/1933 | Farquhar . | |
| 2,079,600 | 5/1937 | Brooks . | |
| 2,817,865 | 12/1957 | Arioli . | |
| 2,958,885 | 11/1960 | Donney . | |
| 3,167,805 | 2/1965 | Zuppinger et al. . | |
| 3,175,331 | 3/1965 | Klein . | |
| 3,206,152 | 9/1965 | Wimmer . | |
| 3,283,357 | 11/1966 | Decker et al. . | |
| 4,190,550 | 2/1980 | Campbell . | |
| 4,228,834 | 10/1980 | Desnick . | |
| 4,480,939 | 11/1984 | Upton . | |
| 4,613,446 | 9/1986 | Magyar . | |
| 4,969,225 | 11/1990 | Schubert . | |
| 5,022,517 | 6/1991 | Benitez . | |
| 5,031,759 | 7/1991 | Ogilvie . | |
| 5,300,249 | 4/1994 | Schwartz et al. | 252/108 |
| 5,366,125 | 11/1994 | Procido . | |
| 5,462,378 | 10/1995 | Webb . | |
| 5,510,050 | 4/1996 | Dunbar et al. | 252/108 |
| 5,540,852 | 7/1996 | Kefauver et al. | 510/152 |
| 5,607,909 | 3/1997 | Kefauver et al. | 510/152 |
| 5,681,980 | 10/1997 | Beerse et al. | 560/151 |

OTHER PUBLICATIONS

Neutrogena Rainbath Shower Care Line—Three New Products (4 pages).

Label—jean Nate(R) "Moisturizing Body Wash Seascape".

*Primary Examiner*—David J. Walczak
*Attorney, Agent, or Firm*—Ronald A. Koatz

[57] ABSTRACT

The invention relates to a cleansing system comprising a synthetic detergent bar and a pouf/sponge for holding the bar. By inserting bar inside the pouf, it has been found that lather can be enhanced, even in compositions comprising lather depressing emollients. The bar holder and bar system also help decrease perception of mush.

7 Claims, 2 Drawing Sheets

SYSTEM COMPRISING SYNTHETIC DETERGENT BAR AND POUF FOR HOLDING BAR

This application claims benefit of provisional application Ser. No. 60/039,496 Filed Mar. 4, 1997.

FIELD OF THE INVENTION

The present invention relates to systems for helping deliver bar compositions to the skin and for helping boost lather. In particular, it relates to devices for holding bars which can be used in applying the bar compositions to the skin. The bar containers may be helpful for delivering consumer beneficial properties which may not be as readily available in synthetic detergent bars. For example, synthetic bars generally use surfactants which are less harsh than soap, but often provide less lather (some synthetic bars may further comprise emollient oils which actually depress lather). The containers may also reduce sensory perception of mush.

BACKGROUND OF THE INVENTION

The use of soap holders or dispensers to hold a bar of soap is itself not new. U.S. Pat. No. 4,480,939 to Upton, for example, discloses a soap holder and dispenser suitable for use in a shower which includes a pack formed from synthetic melting material sized to receive a bar of soap. U.S. Pat. No. 3,167,805 to Zuppinger et al. also teaches a net enclosed soap article.

U.S. Pat. No. 5,462,378 to Webb teaches a wash cloth adapted to receive a bar of soap; and U.S. Pat. No. 4,190,550 discloses pads of non-woven fibers containing a solid core of soap.

In none of these references is it taught or recognized that synthetic surfactant bars, for example, bars containing 5–90%, preferably 10–80% surfactant, when used in a holder, particularly a holder made of a polymeric mesh sponge material (e.g., extruded tubular melting mesh) can remedy some of the deficiencies found in synthetic bars and not found in pure soap bars. For example, a synthetic bar, particular one comprising lesser amounts of surfactants and more structurant (e.g., 5–60% surfactant, preferably 10–50% surfactant and 10–40% structurant such as polyalkylene glycol) may be a less moisturizing bar and therefore require benefit agents/moisturizers. Often these oily moisturizing agents are lather depressants. Use of the bar pouf retainer allows these relatively low surfactant, moisturizer-containing bars to be utilized without sacrificing lather. In addition, synthetic bars tend to be softer/mushier than pure soap bars. Use of the bar container provides sensory signals which allow the consumer to sense less mush. Lesser lather and mush perception are not problems normally associated with non-synthetic soap bar.

In about 1993, Neutrogena introduced a Rainbar® product which was advertised with a body polishing sponge. It is believed, however, that the Neutrogena bar did not comprise 10% to 80% (by weight of bar) acyl isethionate, let alone the preferred isethionate and zwitterionic surfactant system of the invention. Bynum Concepts® also had a sponge product (Bodykiss® advertised to use with bar soap. Again, there is no teaching or suggestion to use with synthetic surfactants, let alone specifically acyl isethionate.

Finally, preferred tubular mesh holders provide other advantages one would expect from a nylon mesh bag such as stimulating skin with the rough material; and/or allowing bars to be readily held during the lathering experience.

BRIEF SUMMARY OF THE INVENTION

In one embodiment, the present invention relates to a soap bar cleansing system comprising:

(1) a synthetic surfactant bar composition comprising:

(a) 5% to 90% by wt., preferably 20% to 60% by wt. synthetic surfactant selected from the group consisting of anionic, nonionic, amphoteric, cationic surfactants and mixtures thereof and wherein the surfactant system preferably comprises at least 10%, preferably 15–80% by wt. total bar of acyl isethionate, i.e., $C_8$ to $C_{24}$, preferably $C_8$ to $C_{18}$ acyl isethionate; and (b) 10% to 90%, preferably 20% to 60% by wt. of a bar structurant selected from the group consisting of $C_8$ to $C_{24}$ fatty acids or ester derivatives or salts thereof (e.g., sodium stearate); $C_8$ to $C_{24}$ alcohols or ether derivatives thereof; polyalkylene glycols having MW between 1000 and 100,000, water soluble starches (e.g., maltodextrin); and hydrophobically modified water soluble polymers (e.g., EO—PO block copolymers or hydrophobically modified PEG); and (2) a light weight polymeric meshed personal cleansing hand held sponge; wherein said sponge is in a form suitable for use as a hand held cleansing implement;

wherein said bar composition is inserted into said sponge such that the sponge encloses the bar composition.

In preferred embodiment, the surfactant system comprise 10% to 80%, preferably 15% to 80% by wt. of bar, of acyl isethionate, i.e., $C_8$ to $C_{24}$, preferably $C_8$ to $C_{18}$ acyl isethionate.

The surfactant bar composition of the invention may comprise 5% to 60% surfactant and greater amounts of structurant relative to surfactant. In addition, it may comprise benefit agent.

In one embodiment the composition comprises:

(a) 5 to 60% surfactant (preferably comprising at least 10% by weight of bar, acyl isethionate);

(b) 10% to 70% by wt. structurant; and (c) 0.01 to 15% by wt. benefit agent/emollient.

In another embodiment, the sponge, in addition to containing/enveloping the bar, additionally has an insert which is kept in the pouf container/sponge during use of soap-in-container.

Figure 1:
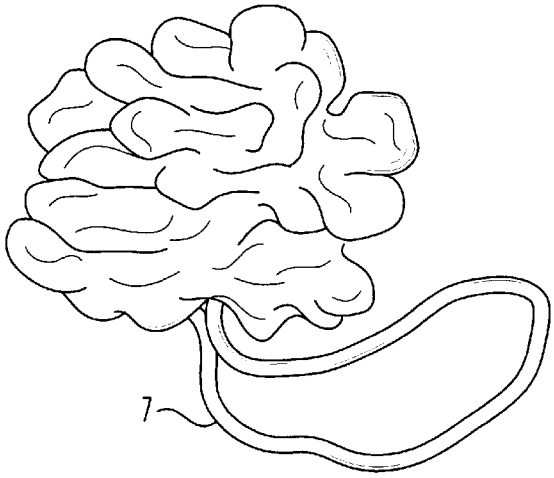
FIG. 1 (PRIOR ART)
FIGS. 1–3 are picture of polymeric meshed material as a sponge (no insert) of prior art.

Specifically:

FIG. 1 is a perspective representation of a diamond mesh polymeric sponge. Rope handle 7 may be used for the pouf.

Figure 2:
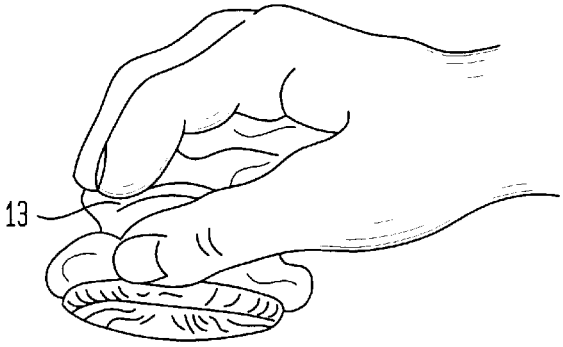
FIG. 2 (PRIOR ART)

FIG. 2 is a picture showing how the sponge can be held in the hand.

Figure 3:
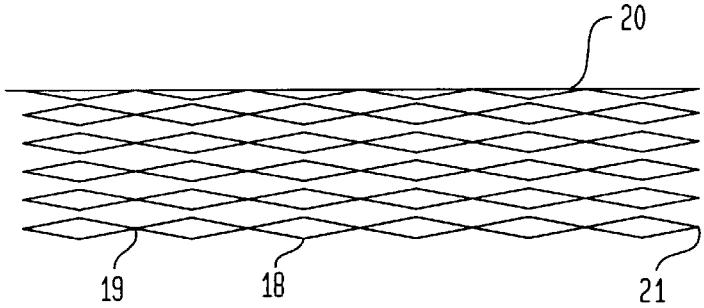
FIG. 3 (PRIOR ART)

FIG. 3 shows netting mesh which can be used to make the sponge.

Figure 4:
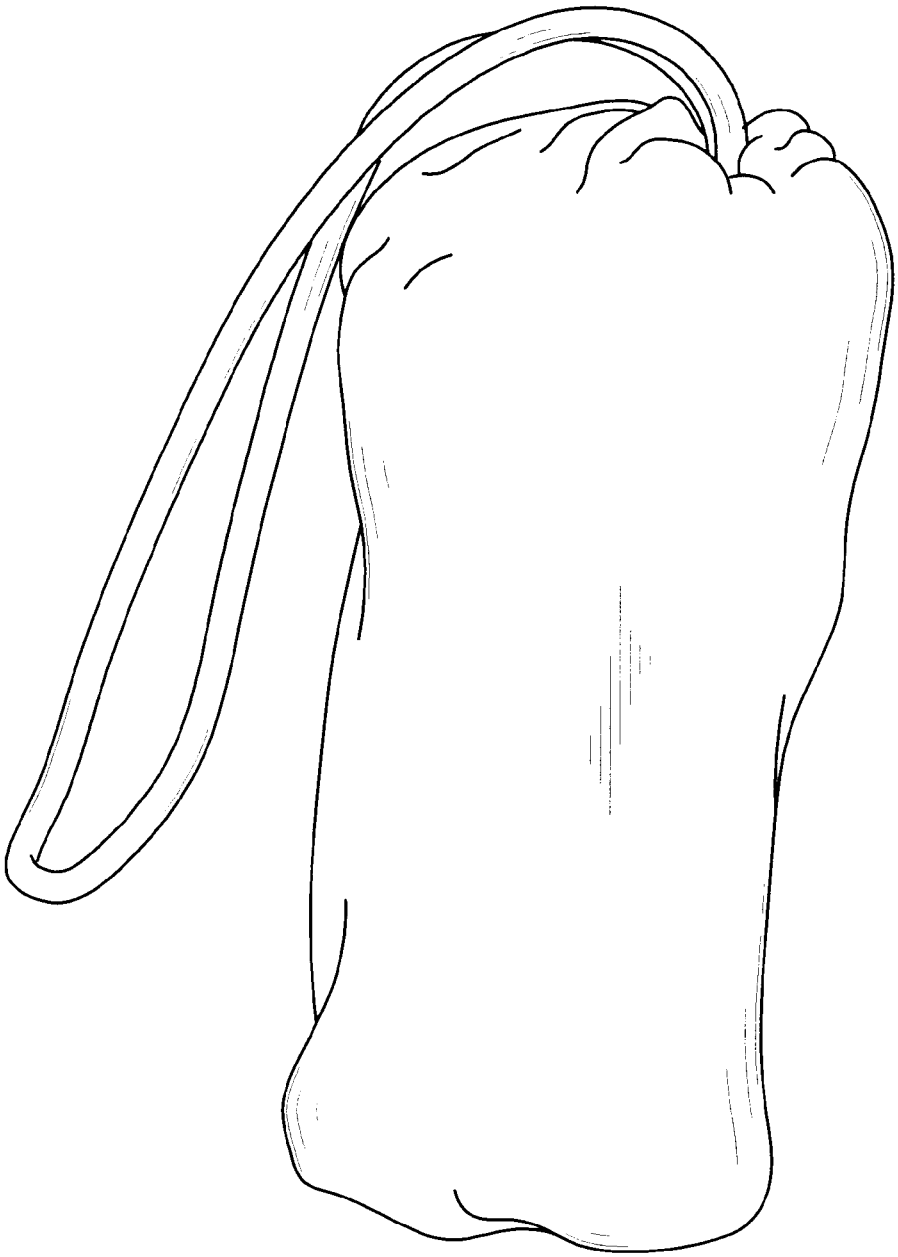

FIG. 4 is a figure of a pouf "bag") of invention designed to hold a bar inserted therein. The figure shows bag in closed position (bar would be inside) with a drawstring pulled to close bag. The bag is made of polymeric meshed material.

The ease with which a cleaning polymeric mesh sponge can be held in the hand for cleaning is shown in FIG. 2. A security band 13 holds the multi-layered netting mesh together to form the polymeric mesh sponge.

The netting mesh that can be used in making the polymeric mesh sponge is illustrated in FIG. 3 wherein 21 represents the mesh in stretched position. The fine polymeric filaments used in making the netting are represented by 18 with 19 representing the spot bonding of the filaments to form the open mesh 20.

DETAILED DESCRIPTION OF INVENTION

The present invention relates to a cleansing system comprising a bar composition and a sponge/pouf completely enclosing/envelop said bar.

More specifically, the system comprises:

(1) a synthetic surfactant bar composition comprising:

(a) 5% to 90% by wt., preferably 20 to 60% synthetic surfactant selected from the group consisting of anionic, nonionic, amphoteric and cationic surfactants and mixtures thereof; and (b) 10% to 90%, preferably 20 to 60% by wt. of a bar structurant and/or filler selected from the group consisting of $C_8$ to $C_{24}$ fatty acid or ester derivatives thereof or salts thereof; $C_8$ to $C_{24}$ alcohols or ether derivatives thereof; polyalkylene glycol having MW between 1000 and 100,000, preferably 200 and 20,000, starches and hydrophobically modified water soluble polymers such as EO—PO block copolymers or hydrophobically modified polyalkyleneglycol; and (2) a light weight polymeric meshed personal cleansing hand held sponge;

wherein said sponge is in a form suitable for use in a hand held cleansing implement; and wherein said bar composition is inserted into said sponge such that the sponge encloses the bar composition.

I BAR COMPOSITION

Surfactant System

The anionic detergent active which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably greater than 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Sulfosuccinates may be monoalkyl sulfosuccinates having the formula:

$R^4O_2CCH_2CH(SO_3M)CO_2M$; and amide-MEA sulfosuccinates of the formula;

$R^4CONHCH_2CH_2O_2CCH_2CH(SO_3M)CO_2M$ wherein $R^4$ ranges from $C_8$–$C_{22}$ alkyl and M is a solubilizing cation.

Sarcosinates are generally indicated by the formula:

$R^1CON(CH_3)CH_2CO_2M$, wherein $R^1$ ranges from $C_8$–$C_{20}$ alkyl and M is a solubilizing cation.

Taurates are generally identified by formula:

$R^2CONR^3CH_2CH_2SO_3M$ wherein $R^2$ ranges from $C_8$–$C_{20}$ alkyl, $R^3$ ranges from $C_1$–$C_4$ alkyl and M is a solubilizing cation.

Particularly preferred are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 10% to about 70% by weight of the total bar composition. Preferably, this component is present from about 30% to about 60%.

The acyl isethionate may be an alkoxylated isethionate such as is described in llardi et al., U.S. Pat. No. 5,393,466, hereby incorporated by reference. This compound has the general formula:

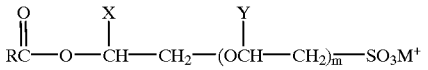

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

It should be understood that the bar may comprise a certain amount of soap as anionic surfactant. Since the invention is related to use of synthetic surfactants inside a sponge, however, it will be understood that there must be a minimum level of synthetic, i.e., at least 5% of all surfactant, preferably at least 20%, more preferably, at least 50% of all surfactant and most preferably 60 to 100% of the surfactant system.

When used, the term "soap" is used in its popular sense, i.e., alkalimetal or alkanol ammonium salt of aliphatic alkane or alkene monocarboxylic acids. Sodium, potassium, mono-, di- and triethanol ammonium cations, or combinations thereof, are suitable for purposes of the invention. Generally, sodium soaps are used. Soaps useful herein are the well known alkali metal salts of natural or synthetic aliphatic (alkanoic or alkenoic) acids having 13 to 22 cations, preferably 12 to 18. They may be described as alkali metal carboxylates of acrylic hydrocarbons having about 12 to 22 carbons.

Amphoteric surfactants which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

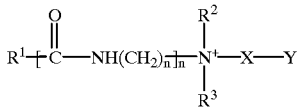

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

m is 2 to 4;

n is 0 to 1;

X is alkylene of 1 to 3 carbon atoms optionally substituted with hydroxyl, and

Y is $—CO_2—$ or $—SO_3—$

Suitable amphoteric surfactants within the above general formula include simple betaines of formula:

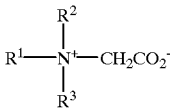

and amido betaines of formula:

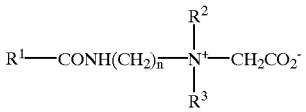

where n is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula:

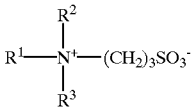

or

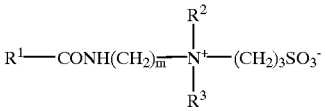

where m is 2 or 3, or variants of these in which $—(CH_2)_3SO_3^-$ is replaced by

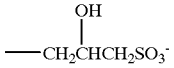

In these formulae $R^1$, $R^2$ and $R^3$ are as discussed previously.

The nonionics which may be used include in particular the reaction products of compounds having a hydrophobic group and a reactive hydrogen atom, for example aliphatic alcohols, acids, amides or alkylphenols with alkylene oxides, especially ethylene oxide either alone or with propylene oxide. Specific nonionic detergent compounds are alkyl ($C_6$–$C_{22}$) phenols ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in Pat. No. 5,009,814 to Kelkenberg, hereby incorporated into the subject application by reference.

Examples of cationic detergents are the quaternary ammonium compounds such as alkyldimethylammonium halogenides.

Other surfactants which may be used are described in U.S. Pat. No. 3,723,325 to Parran Jr. and "Surface Active Agents and Detergents" (Vol. I & II) by Schwartz, Perry & Berch, both of which are also incorporated into the subject application by reference.

One preferable surfactant system comprises:

(a) a first synthetic surfactant which is anionic; and (b) a second synthetic surfactant selected from the group consisting of a second anionic different from the first, a nonionic, an amphoteric and mixtures thereof.

The first anionic can be any of those recited above, but is preferably a $C_8$ to $C_{18}$ isethionate as discussed above. Preferably acyl isethionate will comprise 10% to 90% by wt. total bar composition.

The second surfactant is preferably a sulfosuccinate, a betaine or mixtures of the two. The second surfactant or mixture of surfactant will generally comprise 1% to 10% total bar composition. A particularly preferred composition comprises enough sulfosuccinate to form 3–8% total bar compositions and enough betaine to form 1–5% of total bar composition.

Structuring Aids and/or Fillers

The compositions may also contain 10 to 90% by wt., preferably 20 to 80% by wt. of a structurant and/or filler. Such structurants can be used to enhance the bar integrity, improve the processing properties, and enhance desired user sensory profiles.

The structurant is generally long chain, preferably straight and saturated, ($C_8$–$C_{24}$) fatty acid or ester derivative thereof; and/or branched long chain, preferably straight and saturated, ($C_8$–$C_{24}$) alcohol or ether derivatives thereof.

A preferred bar structurant is polyalkylene glycol with molecular weight between 2000 and 20,000, preferably between 3000 and 10,000. Those PEGs are commercially available, such as those marketed under the tradename of CARBOWAX SENTRY PEG8000® or PEG4000® by Union Carbide.

Other ingredients that can be used as structurants or fillers include starches, preferably water soluble starches such as maltodextrin and polyethylene wax or paraffin wax.

Structuring aids can also be selected from water soluble polymers chemically modified with hydrophobic moiety or moieties, for example, EO—PO block copolymer, hydrophobically modified PEGs such as POE(200)-glycerylstearate, glucam DOE 120 (PEG 120 Methyl Glucose Dioleate), and Hodag CSA-102 (PEG-150 stearate), and Rewoderm® (PEG modified glyceryl cocoate, palmate or tallowate) from Rewo Chemicals.

Other structuring aids which may be used include Amerchol Polymer HM 1500 (Nonoxynyl Hydroethyl Cellulose).

Optional Ingredients

In addition, the bar compositions of the invention may include 0 to 15% by wt. optional ingredients as follows:

perfumes; sequestering agents, such as tetrasodium ethylenediaminetetraacetate (EDTA), EHDP or mixtures in an amount of 0.01 to 1%, preferably 0.01 to 0.05%; and coloring agents, opacifiers and pearlizers such as zinc stearate, magnesium stearate, $TiO_2$, EGMS (ethylene glycol monostearate) or Lytron 621 (Styrene/Acrylate copolymer); all of which are useful in enhancing the appearance or cosmetic properties of the product.

The compositions may further comprise antimicrobials such as 2-hydroxy-4,2'4' trichlorodiphenylether (DP300); preservatives such as dimethyloldimethylhydantoin (Glydant XL1000), parabens, sorbic acid etc.

The compositions may also comprise coconut acyl mono- or diethanol amides as suds boosters, and strongly ionizing salts such as sodium chloride and sodium sulfate may also be used to advantage.

Antioxidants such as, for example, butylated hydroxytoluene (BHT) may be used advantageously in amounts of about 0.01% or higher if appropriate.

Cationic polymers as conditioners which may be used include Quatrisoft LM-200 Polyquaternium-24, Merquat Plus 3330-Polyquaternium 39; and Jaguar® type conditioners.

Polyethylene glycols as conditioners which may be used include:

| | | |
|---|---|---|
| Polyox | WSR-205 | PEG 14M, |
| Polyox | WSR-N-60K | PEG 45M, or |
| Polyox | WSR-N-750 | PEG 7M. |

Another ingredient which may be included are exfoliants such as polyoxyethylene beads, walnut shells and apricot seeds.

Water

Compositions of the invention also comprise 1% to 10% by wt., preferably 4% to 7% by wt. water.

In one embodiment of the invention, the bar composition comprises no more than about 60% surfactant. Said compositions also contain 10% to 70% by wt. structurant/filler.

Because of lower surfactant levels, such compositions would be more "drying" on the skin and such compositions would comprise 0.01 to 10% benefit agent/emollient.

A preferred composition comprises:

(1) 10% to 60% by wt. surfactant as defined above;

(2) 10% to 35% by wt. structurant/filler as defined above; and (3) 0.01 to 10% emollient/benefit agent.

The benefit agent "composition" may be a single benefit agent component or it may be a benefit agent compound added via a carrier. Further the benefit agent composition may be a mixture of two or more compounds one or all of which may have a beneficial aspect. In addition, the benefit agent itself may act as a carrier for other components one may wish to add to the bar composition.

The benefit agent can be an "emollient oil" by which is meant a substance which softens the skin (stratum corneum) by increasing into water content and keeping it soft by retarding decrease of water content.

Preferred emollients include:

(a) silicone oils, gums and modifications thereof such as linear and cyclic polydimethylsiloxanes; amino, alkyl alkylaryl and aryl silicone oils;

(b) fats and oils including natural fats and oils such as jojoba, soybean, rice bran, avocado, almond, olive, sesame, persic, castor, coconut, mink oils; cacao fat; beef tallow, lard; hardened oils obtained by hydrogenating the aforementioned oils; and synthetic mono, di and triglycerides such as myristic acid glyceride and 2-ethylhexanoic acid glyceride;

(c) waxes such as carnauba, spermaceti, beeswax, lanolin and derivatives thereof;

(d) hydrophobic plant extracts;

(e) hydrocarbons such as liquid paraffins, vaseline, microcrystalline wax, ceresin, squalene, pristan and mineral oil;

(f) higher fatty acids such as lauric, myristic, palmitic, stearic, behenic, oleic, linoleic, linolenic, lanolic, isostearic and poly unsaturated fatty acids (PUFA);

(g) higher alcohols such as lauryl, cetyl, stearyl, oleyl, behenyl, cholesterol and 2-hexydecanol alcohol;

(h) esters such as cetyl octanoate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate and alkyl tartrate;

(i) essential oils such as mentha, jasmine, camphor, white cedar, bitter orange peel, ryu, turpentine, cinnamon, bergamot, citrus unshiu, calamus, pine, lavender, bay, clove, hiba, eucalyptus, lemon, starflower, thyme, peppermint, rose, sage, menthol, cineole, eugenol, citral, citronelle, borneol, linalool, geraniol, evening primrose, camphor, thymol, spirantol, penene, limonene and terpenoid oils;

(j) lipids such as cholesterol, ceramides, sucrose esters and pseudo-ceramides as described in European Patent Specification No. 556,957;

(k) vitamins such as vitamin A and E, and vitamin alkyl esters, including those vitamin C alkyl esters;

(l) sunscreens such as octyl methoxyl cinnamate (Parsol MCX) and butyl methoxy benzoylmethane (Parsol 1789);

(m) phospholipids; and (n) mixtures of any of the foregoing components.

A particularly preferred benefit agent is silicone, preferably silicones having viscosity greater than about 10,000 centipoise. The silicone may be a gum and/or it may be a mixture of silicones. One example is polydimethylsiloxane having viscosity of about 60,000 centistokes.

II SPONGE/IMPLEMENT

The cleansing system of the invention additionally comprises a light weight polymeric meshed personal hand held sponge.

The cleansing polymeric mesh sponge can be prepared from readily available raw materials or with specially designed mesh materials. The polymeric mesh sponge is preferably prepared from extruded tubular netting mesh which has been prepared from special strong and flexible polymeric material. Extruded tubular netting mesh of this type, and particularly those prepared from polyethylene, have been used for the covering of meat and poultry and are readily available in industry.

The polymeric mesh sponge comprises a plurality of plys of an extruded tubular netting mesh prepared from a strong flexible polymer, preferably of the group consisting of addition polymers of olefin monomers, and polyamides of polycarboxylic acids and polyamines, said plys of tubular netting mesh are folded upon itself numerous times to form a soft ball-like polymeric mesh sponge.

The tubes or stripes of netted mesh polymer can be securely attached by means of a nylon band or suitable closure. This type of polymeric mesh sponge is disclosed in U.S. Pat. No. 4,462,135, Jul. 31, 1984, to Sanford, incorporated herein by reference.

An example of a hand-held ball-like polymeric mesh sponge is disclosed in U.S. Pat. No. 5,144,744, to Campagnali, Sep. 8, 1992, incorporated herein by reference. It is a diamond-mesh polyethylene sponge obtained from a number of netting tubes stretched over supports, joined and bound together at the center and then released from the supports.

Commercially available "polymeric mesh sponges" are sold by The Body Shop and Bynum Concepts, Inc. Other suppliers include Supremia Use in New Jersey, Sponge Factory Dominicana in the Dominican Republic and Integrated Marketing Group in Harrison, N.Y.

The following are some, although certainly not all, specifications for suitable bath polyethylene polymeric mesh sponges:

| Size Dia. | Tubes | Ea. Length | Total Length | Wt. gm. |
|---|---|---|---|---|
| 3" | 2 | 60 cm | 120 cm | 15 |
| 4" | 4 | 50 cm | 200 cm | 23 |
| 5" | 4 | 80 cm | 320 cm | 37 |

One (1") inch = 2.54 cm; 3" = 3 × 2.54 - cm: 4" = 4 × 2.54 = cm: etc.

FIG. 1 is a perspective representation of a diamond-mesh polymeric hand held ball-like bath sponge showing a rope handle 7 which can be used in the present invention. The ease with which a cleansing polymeric mesh sponge can be held in the hand for cleaning is shown in FIG. 2. A security band 13 hold the multi-layered netting mesh together to form the polymeric mesh sponge. The netting mesh that can be used in making the polymeric mesh sponge is illustrated in FIG. 3. wherein 21 represents the mesh in stretched position. The fine polymeric filaments used in making the netting are represented by 18 with 19 representing the spot bonding of the filaments to form the open mesh 20.

Two 2 netting tubes at 60 cm length each can be used to make a 3-inch ball sponge. They can be bundled manually with a loop or rope to form a ball-like polymeric mesh sponge. Other designs such and rectangular gloves and washing implements made with the mesh material also work very well in the system of the present invention.

As seen in FIG. 4, the bag has an opening into which bar is inserted. Typically there is some form of closure mechanism, e.g., a drawstring around the outside of the bag which can be drawn or closed once the bar is inside. Other closure systems may also be used in theory.

The following examples are intended to better illustrate the invention and are not intended to be limiting in any way.

EXAMPLES

Bars having the following general formulation were used to determine differences in lather performance

| | % BY WT. |
|---|---|
| BAR A | |
| Fatty acid isethionate | 40–60% |
| Free fatty acids | 15–35% |
| Sodium isethionate | 3–8% |
| Sulfosuccinate | 3–8% |
| Betaine | 1–5% |
| Water & minors | to balance |
| BAR B | |
| Fatty acid isethionate | 25–55% |
| Polyalkylene glycol | 20–30% |
| Free fatty acid | 5–10% |
| Betaine | 3–8% |
| Emollient oil | 2–15% |
| Starch (e.g., maltodextrin) | 5–10% |
| Water & minors | to balance |

Bar B compositions were used with and without a pouf implement.

Protocol

A consumer study was conducted wherein consumers were given either Bar A, Bar B with pouf or Bar B without pouf to use at home for a period of two weeks and asked to fill out a questionnaire.

Relevant to the subject invention, the following questions relating to lather attributes were presented.

1. The bar provided sufficient lather during the shower;
2. The bar provided sufficient lather during facial washing.
3. The bar lather was bubbly; and
4. The bar lather was thick and creamy.

For each statement, the subjects were giving a choice of 7 responses ranging as follows:

(1) Disagree completely;
(2) Disagree strongly;
(3) Disagree somewhat;
(4) Neither agree nor disagree;
(5) Agree somewhat;
(6) Agree strongly; and
(7) Agree completely.

Using standard and well known statistical analysis techniques, significant differences were found between the responses for Bar B with pouf compared to Bar B without pouf for statements 1 and 3 above (lather during shower and bubbles). Significant difference is measured at 99.557 and 99.98% confidence levels respectively.

For statement 4 (lather thick and creamy) statistical analysis showed significant difference between Bar B with pouf relative to Bar B without pouf at 94.06 confidence level.

No statistic difference was found for statement 2 relating to facial washing. while not wishing to be bound by theory, this may be because people removed the bars from pouf for facial washing or that differences are not as readily noted when washing the face.

What is claimed is:

1. A cleansing system comprising:

(1) a bar composition comprising:

(a) 5% to 90% by wt. of a surfactant selected from the group consisting of anionic surfactants, nonionic surfactants, amphoteric surfactants, cationic surfactants and mixtures thereof wherein at least 50% of surfactant is synthetic;

(b) 10% to 90% by wt. of a bar structurant selected from the group consisting of fatty acids and esters or salts thereof; alcohols and ethers thereof; polyalkylene glycols of MW2000 to 100,000; starches and hydrophobically modified water soluble polymer;

(c) 0.1% to 15% benefit agent, emollient; and (d) 0% to 10% by wt. water; and (2) a light weight polymeric meshed personal cleansing hand held sponge;

where said sponge is in a form suitable for use in a hand held cleansing implement, wherein said bar composition (1) is inserted into said sponge (2) such that the sponge envelopes the bar composition.

2. A cleansing system according to claim 1 comprising 5% to 60% surfactant and additionally comprising a benefit agent.

3. A cleansing system according to claim 1 comprising:

(a) 5 to 60% by wt. surfactant;

(b) 10 to 70% by wt. structurant; and (c) 0.01 to 15% by wt. benefit agent/emollient.

4. A cleansing system according to claim 3, comprising;

(a) 10 to 60% surfactant;

(b) 10 to 35% structurant/filler; and (c) 0.01 to 10% emollient/benefit agent.

5. A cleansing system according to claim 1, wherein (a) comprises 20% to 60% by wt. surfactant.

6. A cleansing system according to claim 1, wherein (b) comprises 20% to 60% by wt. structurant and/or filler.

7. A cleansing system according to claim 1, wherein the surfactant system comprises $C_8$–$C_{18}$ acyl isethionate.

* * * * *